United States Patent [19]

Brock et al.

[11] 4,131,954

[45] Jan. 2, 1979

[54] COLLAPSIBLE HEADGEAR

[76] Inventors: Louis C. Brock, 13468 Forest Lac, St. Louis County, Mo. 63141; Richard H. Nielson, 735 Bartolet, St. Louis County, Mo. 63125

[21] Appl. No.: 829,224

[22] Filed: Aug. 31, 1977

[51] Int. Cl.[2] ..... A42B 1/20; A45B 11/04

[52] U.S. Cl. ..... 2/177; 135/5 C; 135/20 R; 135/29

[58] Field of Search ..... 135/2, 29, 5 C, 19.5, 135/20 R; 2/177, 171

[56] References Cited

U.S. PATENT DOCUMENTS

| | | | |
|---|---|---|---|
| 250,803 | 12/1881 | Gray | 2/177 |
| 841,245 | 1/1907 | Gurney | 135/29 |
| 1,145,195 | 7/1915 | Heisler | 135/29 |
| 2,140,647 | 12/1938 | Myers | 2/177 |
| 2,227,554 | 1/1941 | Riordon | 2/177 |
| 2,336,116 | 12/1943 | Morando | 135/29 |
| 2,551,963 | 5/1951 | Myers | 135/20 R |
| 2,864,389 | 12/1958 | Smith et al. | 135/2 |
| 3,049,720 | 8/1962 | Caine | 135/20 R X |
| 3,315,275 | 4/1967 | Erbb | 2/177 |
| 3,374,488 | 3/1968 | Erbb | 2/177 |

FOREIGN PATENT DOCUMENTS

| | | | |
|---|---|---|---|
| 450887 | 7/1936 | United Kingdom | 135/2 |
| 974202 | 11/1964 | United Kingdom | 135/29 |

*Primary Examiner*—Ernest R. Purser
*Assistant Examiner*—Conrad L. Berman
*Attorney, Agent, or Firm*—Gravely, Lieder & Woodruff

[57] ABSTRACT

A collapsible headgear includes rib members having somewhat spherical inner ends that fit into radial sockets in a hub, thus enabling the rib members to fold from a collapsed condition, in which they lie along the hub axis, to an erected condition in which they project from the hub. The movement from one condition to the other is produced by a collar and struts that extend between the collar and the rib members. The struts are connected at their outer ends to the rib members by clevises, and have generally spherical inner ends that fit into radial sockets in the collar. Consequently, when the collar is moved upwardly toward the hub, the struts are driven outwardly, and the struts in turn drive the rib members to their erected positions. A cover extends over the rib members, and the cover, rib members, and struts, when erected, are supported above the user's head by supports which extend downwardly from the struts and at their lower ends are fitted with a headband. The upper ends of the supports are apertured and the struts fit through the apertures that are so formed.

15 Claims, 8 Drawing Figures

COLLAPSIBLE HEADGEAR

BACKGROUND OF THE INVENTION

This invention relates in general to headgear and more particularly to headgear capable of being collapsed into a highly compact configuration.

Certain types of headgear must of necessity be quite large. For example, hats designed to protect the wearer's face from the direct rays of the sun often have large brims. The same is true of rain hats, although to a lesser extent. Because of their size, these hats are difficult to store in closets, on shelves, and on hat racks and they are further quite cumbersome when merely carried instead of being worn. Furthermore, most wide brim hats do not offer adequate protection from either sun or rain. They are also quite heavy and almost wholly lacking in ventilation. As a result, they are quite uncomfortable.

SUMMARY OF THE INVENTION

One of the principal objects of the present invention is to provide headgear which when worn provides a large protected area beneath the wearer's head. Another object is to provide headgear of the type stated which collapses into a compact configuration that is capable of being easily carried. A further object is to provide headgear of the type stated which is sturdy in construction and easy to manufacture. An additional object is to provide headgear of the type stated which is comfortable to wear in that it is extremely light in weight and affords the head area a substantial amount of ventilation. These and other objects and advantages will become apparent hereinafter.

The present invention is embodied in headgear having a hub, rib members extended from the hub, a collar located along the axis of the hub, struts between the collar and rib members, a cover over the rib members, supports having apertures through which the struts extend so that the supports depend from the struts, a cover over the rib members, and a headband connected to the lower ends of the struts. The invention also resides in a collapsible headgear in which the ribs and struts have somewhat spherical portions at their ends, with the spherical portions of the ribs being received in sockets in the hub and the spherical portions of the struts being received in sockets in the collar, thus enabling the ribs and struts to fold with respect to the hub and collar, respectively. The invention also consists in the parts and in the arrangements and combinations of parts hereinafter described and claimed.

DESCRIPTION OF THE DRAWINGS

In the accompanying drawings, which form part of the specification and wherein like numerals and letters refer to like parts wherever they occur.

DETAILED DESCRIPTION

Figure 1:
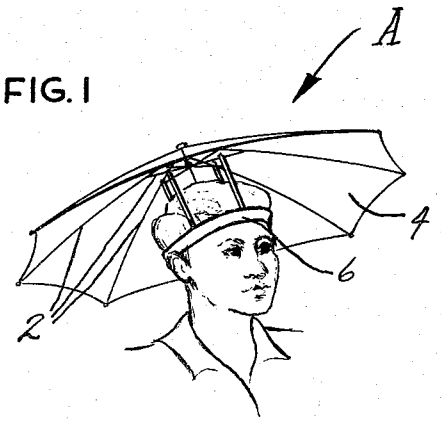
FIG. 1 is a perspective view of the collapsible headgear of the present invention shown in its erected condition as it would be when worn by the user.

Referring now to the drawings, A(FIG. 1) designates a headgear which somewhat resembles an umbrella in appearance, but is smaller. The headgear A is worn on the head much like a hat, only the major portion of it is positioned above the head so that the scalp area receives maximum ventilation. The headgear A projects a substantial distance laterally in all directions beyond the head so that a relatively large area around the head is protected. The headgear A may be used as protection against the rays of the sun, or in a slightly different embodiment it may be used as protection from rain.

Basically, the headgear A includes (FIGS. 1&2) collapsible frame 2 and a cover 4 which fits over the frame 2 and is attached permanently to it. When the headgear A is utilized as a sun shade, the cover should be formed from a substantially opaque material such as nylon fabric. On the other hand, when utilized as a rain hat, the cover should be formed from a transparent plastic film. In addition, the headgear A includes a flexible headband 6 which is attached to the frame 2 and is sized to fit around user's head.

Figure 4:
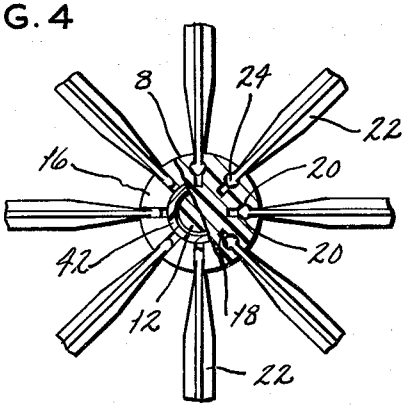
FIG. 4 is a sectional view taken along line 4—4 of FIG. 2 and showing the hub from which the ribs radiate.

The collapsible frame 2 has a hub 8 which is preferably injection molded from plastic and establishes a center axis X for the headgear A. The hub 8 includes (FIGS. 2&3) a threaded stud 10 projected axially in one direction and cylindrical retaining stud 12 projected axially in another direction, the latter being provided with a slightly raised circumferential lip. Between the two studs 10 and 12 is a flange 16 that has radial slots 18 (FIG. 4) which open both laterally and downwardly but are closed at their upper ends. Near the innermost end of each slot 18 is a bearing face of arcuate configuration and adjacent to that face, the side walls of the slot are relieved to provide opposed recesses 20 of concave configuration. The recesses 20 may be formed by drilling holes downwardly in the axial direction into the slots 18, with the diameter of the holes being slightly greater than the width of the slots. The holes terminate short of the lower face of the flange 16. Moreover, the hole forms the arcuate bearing face of the slot 18. The slots 18 together with the concave recesses 20 form sockets in the hub 8.

The hub 8 serves to connect a plurality of ribs 22 together, and these ribs 22 are preferably injection molded from plastic. The inner end of each rib 22 fits into one of the slots 18 where it is provided with a generally spherical or enlarged end portion 24 (FIG. 4) that projects laterally beyond the adjacent portion of the rib 22 and is wider than the slots 18. The inner end of each rib 22 fits into a different slot 18, with its spherical portion 24 bearing against the arcuate bearing face of the slot 18 and its sides projecting into the concave recesses 20. As a consequence, the inner end of each rib 22 is engaged with the hub 8 in a manner that enables it to pivot easily toward and away from the hub axis X, yet prevents it from being detached from the hub 8. At its outer end, the rib 22 is provided with a downwardly directed clevis 26. Projected from the outer end of each rib 22 is a rib extension 28 which when undistorted forms more or less a straight line continuation of the rib 22. Whereas the ribs 22 are molded from plastic, the rib extensions 28 are preferably formed from a metal wire such as steel. They are considerably more flexible than the ribs 22. The inner end of each rib extension 28 is preferably embedded in the plastic of its rib 22. Each rib and its rib extension together form a rib member.

Figure 2:
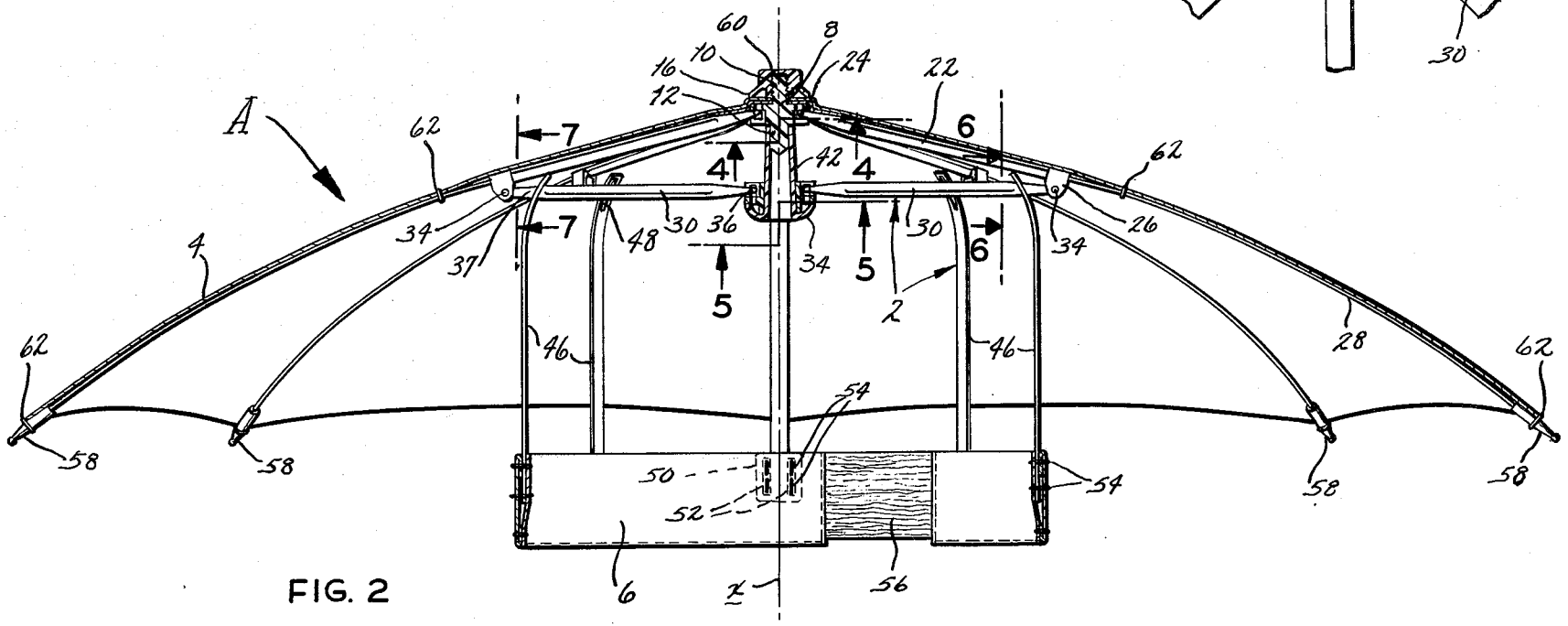
FIG. 2 is a sectional view of the headgear in elevation with the headgear in its erected condition.
Figure 3:
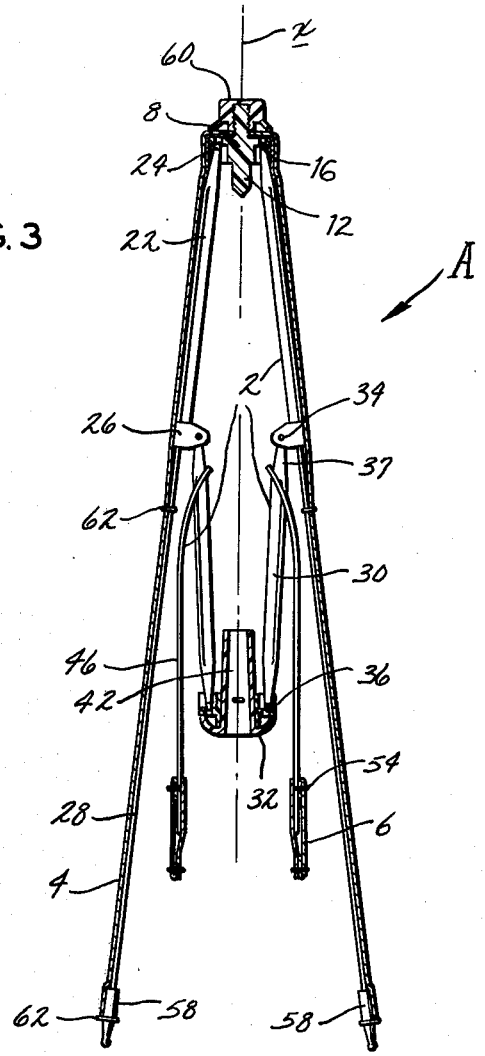
FIG. 3 is a sectional view of the headgear in elevation with the headgear being in its collapsed condition.
Figure 7:
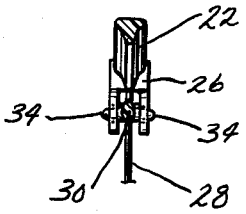
FIG. 7 is a fragmentary sectional view taken along line 7—7 of FIG. 2 and showing the clevis and lateral pins at the outer ends of a rib and its connected strut, respectively.

Each clevis 26 connects with a strut 30 that extends inwardly therefrom to a connecting collar 32. Both the strut 30 and collar 32 are rigid elements that are preferably molded from plastic. The outer ends of the struts 30 fit into the clevises 26, each being retained within its respective clevis 26 by lateral pins 34 that fit into the apertures of the clevis 26 (FIGS. 2, 3, & 7). The pins 34 are preferably molded integral with the major portion of the strut 30 and are short enough to be fitted into the clevis 26 when the clevis 26 is spread slightly within its elastic limits. At the innermost end of each strut 30 is a generally spherical or enlarged end portion 36 having the same configuration the spherical portions 24 of the ribs 22. Moreover, each strut 30 immediately prior to its lateral pins 34 tapers downwardly along a tapered portion 37 of reduced thickness.

Figure 5:
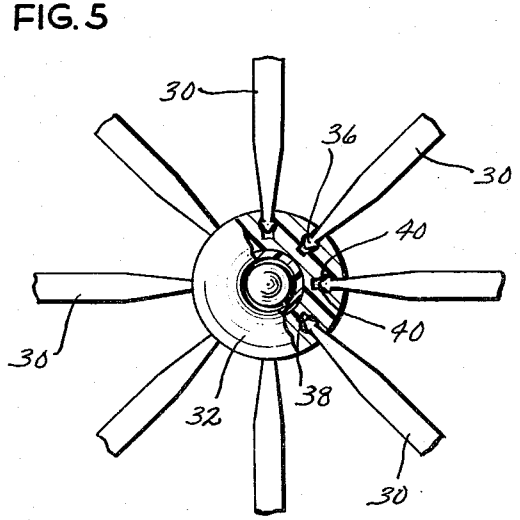
FIG. 5 is a partial sectional view taken along line 5—5 of FIG. 2 and showing the collar from which the struts radiate.

The collar 32 has radially directed slots 38 (FIG. 5) which are equal in number to the struts 30 and the inner end 40 of each strut 30 fits into a different slot 38. Each slot 38 at its inner end has an arcuate bearing face and adjacent to the bearing face the side walls of the slots 38 are relieved to provide concave recesses 40 into which the spherical end portion 36 of the strut 30 for that slot fits, so that the strut 30 is retained on the collar 32. Like the corresponding slots 18 on the hub 8, the slots 38 on the collar 32 open radially. They also open upwardly, but their lower ends are closed. In effect, the slots 38 and concave recesses 40 form sockets in the collar 32, and may be formed in a manner identical to their counterparts in the flange 16 of the hub 8. Fitted through the collar 32 is a connecting sleeve 42 which projects axially toward the hub. The inside diameter of the sleeve 42 is about the same as that of the retaining stud 12 on the hub 8, so that the sleeve 42 when pushed upwardly a sufficient distance, will engage stud 12 on the hub 8. The lengths of the sleeve 42, the ribs 22, and the struts 30 are all such that when the sleeve 42 is pushed upwardly and fully engaged with the retaining stud 12 on the hub 8 (FIG. 2), in which case its upper end is against the lower surface of the flange 16 for the lower hub 8, the struts 30 will be in a generally horizontal disposition, while the ribs 22 will be inclined downwardly at a slight angle to it horizontal. However, when the sleeve 42 and collar 32 are pulled away from the hub 8 to the fullest extent (FIG. 3), the ribs 22 and rib extensions 28 will be generally parallel to the axis of the hub 8 and the struts 30 will be located along the insides of the rib extensions 28.

Figure 6:
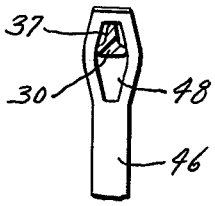
FIG. 6 is a fragmentary sectional view taken along line 6—6 of FIG. 2 and showing the upper end of one of the supports.

The struts 30 near their outer ends are connected with upright supports 46 (FIG. 2) that extend downwardly and are attached at their lower ends to the headband 6. The supports 46 are likewise molded from plastic, only the plastic is more flexible than that from which the ribs 22 and struts 30 are molded. Each support 46 at its upper end has a generally rectangular aperutre 48 (FIG. 6) which is elongated in the vertical direction, and this aperture 48 receives the outer end of the strut 30, that is, the tapered portion 37 that leads up to the spherical end portion 36. The aperture 48 is somewhat narrower than the major portion of the strut 30 so there is little tendency for the support to move off the tapered portion of the strut 30 toward the center of the strut 30. Furthermore, when the struts 30 are horizontal and are located slightly below their respective ribs 22, as is the case when the frame 5 is erected, the upper ends of the supports 46 bear against the underside of the ribs 22 and this further serves to prevent the supports from migrating inwardly (FIG. 2). This occurs by reason of the fact that the distance each support 46 extends above its aperture 48 is slightly greater than the spacing between the strut 30 over which the support 46 fits and the overlying rib 22 so that the upper end of the support 46 is cocked outwardly at a slight angle with respect to the vertical. However, the headband 6 at the lower ends of the supports 46 prevents the supports 46 from spreading outwardly. As a result, all of the supports 46 bow outwardly at their upper ends and then assume a generally vertical disposition. At its lower end, each support 46 has an enlarged portion 50 that fits within the head-band 6, and the enlarged portion 50 is provided with two vertical apertures 52 through which stitching 54 is directed.

The headband 6 consists of inner and outer plies of a suitable fabric material such as nylon. The inner ply passes to the inside of the enlarged portions 50 on the supports 46, whereas the outer ply passes to the outside of those enlarged portions so that the enlarged portions 50 are interposed between the plies and are fully obscured. Between two of the supports 46 the double ply fabric material is interrupted and replaced with a short elastic band 56 (FIG. 2) which enables the headband 6 to accommodate varying head sizes.

The cover 4 fits over the ribs 22 and rib extensions 28 and extends all the way out to the free ends of the rib extensions 28, where the rib extensions 28 are fitted with end ferrules 58 (FIG. 2). The threaded stud 10 on the hub 8 projects through the center of the fabric cover 4, and threaded over the stud 10 is a cap 60 which retains the center of the cover 4 in place. Slightly beyond the outer ends of ribs 22 the cover 4 is secured to the rib extensions 28 by stitching 62 and the cover 4 is secured to the end ferrules 58 by more stitching 62.

In use, the headgear A is normally carried and stored in its collapsed condition (FIG. 3). In that condition, the connecting sleeve 42 on the collar 32 is detached and displaced from the hub 8 as far as possible. As a consequence, the ribs 22 and rib extensions 28 are generally parallel to one another along the axis X of the hub 8. The supports 46 lie immediately inwardly from the rib extensions 28 and the struts 30 are located inwardly from the supports 46. In other words, in the collapsed condition the supports 46 are interposed between the rib extensions 28 and the struts 30. The cover 4 folds up between the ribs 22 and rib extensions 28, as does the headband 6.

To erect the headgear A (FIG. 2), the collar 32 is forced upwardly toward the hub 8 with the sleeve being aligned with the retaining stud 12 on the hub 8. This drives the struts 30 outwardly at a greater angle with respect to the center axis X, and the struts 30 in turn drive the ribs 22 and rib extensions 28 outwardly. Moreover, the upper ends of the flexible supports 46 become lodged between the tapered portions 30 of the struts 30 and the overlying ribs 22 are cocked outwardly at a slight angle so that the upper ends of the struts 30 assume a bowed configuration. When the end of the sleeve 42 comes to the retaining stud, the struts are almost horizontal. The sleeve is then forced over the retaining stud 12 and is engaged with the circumferential lip 14 on the stud. This last increment of movement causes the cover 4 to stretch tightly over the ribs 22 and rib extensions 28 and further causes the struts 30 to move over center with respect to the horizontal. As a consequence, the stretched fabric of the cover 4, instead of urging the collar 32 downwardly, urges it upwardly against the hub 8. The headband 4 furthermore, due to the tendency of the upper ends of the supports 46 to assume the bowed configuration, acquires a circular configuration and is easily placed over the user's head.

The headgear A is ideally suited for shading the user's head from the direct rays of the sun, yet affords maximum ventilation to the user's scalp.

MODIFICATION

Figure 8:
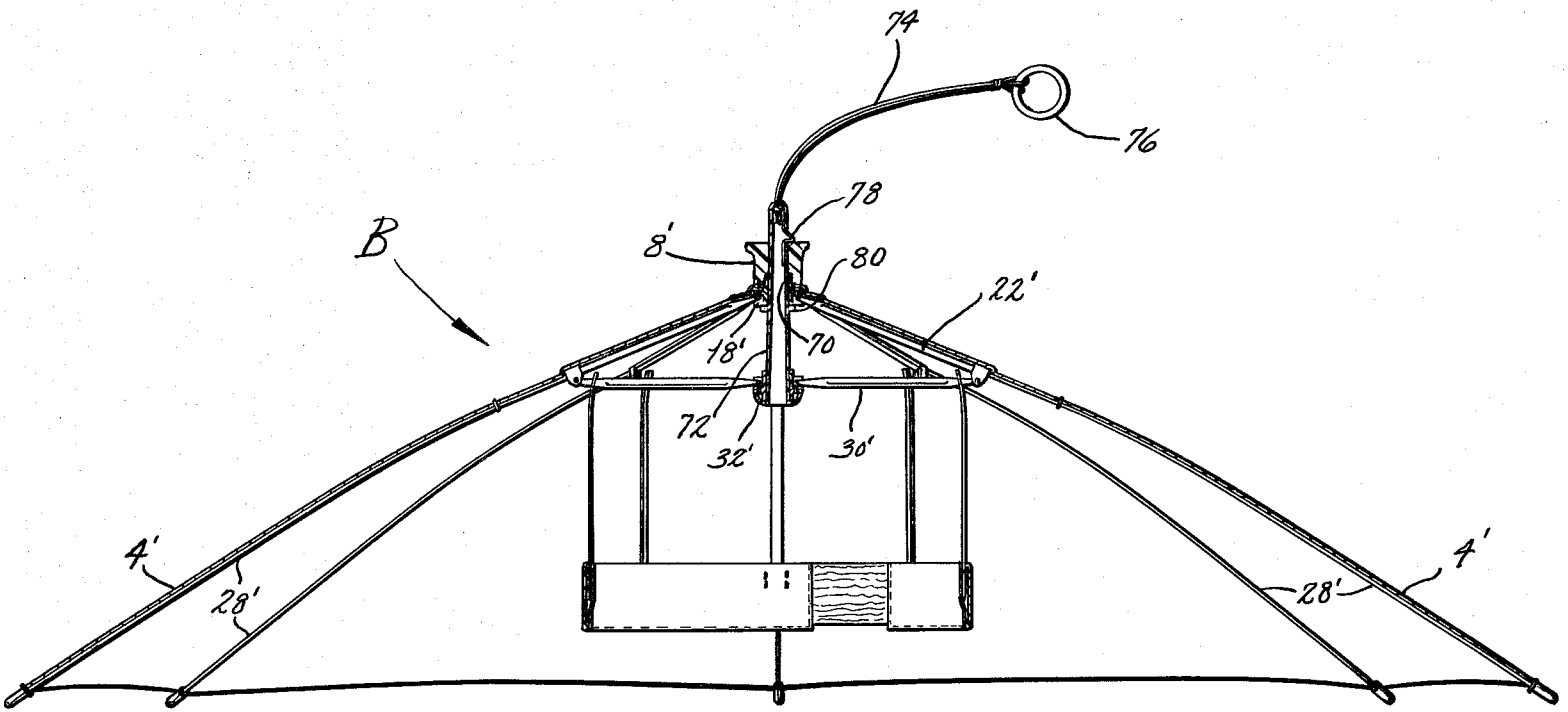
FIG. 8 is a sectional view in elevation of a modified collapsible headgear.

A modified headgear B (FIG. 8) may be used to protect the wearer's head during rain showers. The modified headgear B is quite similar to the headgear A, and indeed its ribs 22' and struts 30' are identical. However, the hub 8' from which the ribs 22' emanate, while having the outwardly and downwardly opening slots 18', is provided with a center bore 70. The collar 32' from which the struts 30' emanate, on the other hand, has an elongated projection 72 from which a pull string 74 extends, and this string passes through the center bore 70 in the hub 8', beyond which it is provided with a pull ring 76. Moreover, the projection 72 is provided with a spring detent 78 near its upper end and a stop 80 spaced downwardly therefrom a distance equal to the length of the hub 8'. When the pull string 74 is pulled through the hub 8, the projection 72 is guided into the bore 70 until the stop 80 comes against the lower end of the hub 8'. When the projection 72 is so disposed, the spring detent 78 is projected outwardly over the top of the hub 8', and the struts 30' are in a horizontal disposition.

Aside from the differences in the hub and collar, the rib extensions 28' are somewhat longer and the cover 4 is correspondingly longer so as to completely cover the rib extensions 28'. Furthermore, the cover 4' is formed from a transparent material such as polyethylene film. Indeed, the extent of the cover is sufficient to enable it to pass downwardly over the user's face and thus provide complete protection for his head during a rain shower.

This invention is intended to cover all changes and modifications of the example of the invention herein chosen for purposes of the disclosure which do not constitute departures from the spirit and scope of the invention.

What is claimed is:

1. A collapsible headgear comprising: a hub; rib and strut assemblies comprising rib members connected at their inner ends with the hub and being capable of folding toward and away from the axis of the hub, a collar along the axis of the hub and being capable of moving toward and away from the hub and struts connected between the collar and the rib members and being capable of folding with respect to both the collar and the rib members, whereby the struts will push the ribs outwardly when the collar is moved toward the hub and will draw the rib members inwardly when the collar is moved away from the hub; supports having at their upper ends apertures and being slidable with respect to the rib and strut assemblies, with the supports extending downwardly from the rib and strut assemblies generally in the direction of the hub axis; a headband connected to the lower ends of the supports; and a cover extended over and attached to the rib members, the cover forming a protective surface above the headband when the collar is moved toward the hub and the rib members are forced outwardly, but being folded in a collapsible condition when the collar is moved away from the hub to its fullest extent.

2. A headgear according to claim 1 wherein each rib member includes a rib at its inner end and a rib extension at its outer end with the rib extension forming a continuation of the rib; and wherein the strut is connected to the outer end of the rib.

3. A headgear according to claim 2 wherein the ribs and the struts are formed from relatively rigid material and the supports are formed from relatively flexible material.

4. A headgear according to claim 3 wherein each strut has a portion of reduced thickness immediately inwardly from the location at which it is attached to its rib member, and the aperture in each support receives the portion of reduced thickness for one of the struts.

5. A headgear according to claim 4 wherein the distance each support extends upwardly beyond its aperture exceeds the spacing between the strut and the overlying rib when the headgear is erected, so that the upper ends of the flexible supports turn outwardly when the headgear is erected.

6. A headgear according to claim 3 wherein the rib extensions have greater flexibility than the ribs.

7. A headgear according to claim 2 wherein the ribs at their inner ends have generally spherical portions and the hub has sockets that open radially and downwardly and into which the spherical portions fit.

8. A headgear according to claim 7 wherein the struts at their inner ends have generally spherical portions and the collar has sockets that open radially and upwardly and into which the spherical portions of the struts fit.

9. A headgear according to claim 8 wherein the ribs at their outer ends have clevises and the struts at their outer ends are pinned to the clevises.

10. A headgear according to claim 1 and further comprising means for securing the collar and the hub together.

11. A headgear according to claim 10 wherein the hub has an axial bore and the means for securing the collar and hub includes an axial projection on the collar, the axial projection being received in the bore when the headgear is erected, and a detent on the axial projection, the detent being capable of engaging the hub.

12. A headgear according to claim 11 and further comprising a pull string extended from the axial projection through the axial bore in the hub for moving the collar to the hub.

13. A headgear according to claim 10 wherein the means for securing the hub and the collar includes a retaining stud projected axially from the hub and a sleeve projected axially from the collar, the sleeve being fitted over the stud when the headgear is erected.

14. A collapsible headgear comprising a hub having sockets that open outwardly and downwardly; a rib and strut assembly including ribs having generally spherical inner ends that fit into and are retained in the sockets of the hub, whereby the ribs may be folded between a collapsed position in which they lie along the hub axis and an erected position in which they project outwardly from the hub, a collar located along the hub axis beneath the hub and having sockets that open outwardly and upwardly, and struts connected at their outer ends to the ribs such that they are capable of folding with respect to the ribs, the struts having generally spherical inner ends that fit into the sockets in the collar, so that the struts fold with respect to the collar, whereby when the collar is moved toward the hub, the struts will force the ribs outwardly, and when the collar is moved away from the hub, the struts will draw the ribs downwardly toward the hub axis; support means for holding the hub and the rib and strut assembly in an elevated position above the wearer's head and including supports extending downwardly from the struts and a headband attached to the lower ends of the supports, the supports at their upper ends being slidable with respect to the rib and strut assembly; and a cover extended over the ribs.

15. A headgear according to claim 14 wherein the supports have apertures at their upper ends, and the struts fit through the apertures.

* * * * *